United States Patent [19]

Feldmeier

[11] 4,149,343

[45] Apr. 17, 1979

[54] SURFACE-GRINDING METHOD AND APPARATUS

[75] Inventor: Fritz Feldmeier, Nuremberg, Fed. Rep. of Germany

[73] Assignee: Georg Müller Kugellager Fabrik K.G., Fed. Rep. of Germany

[21] Appl. No.: 823,159

[22] Filed: Aug. 9, 1977

[30] Foreign Application Priority Data

Aug. 14, 1976 [DE] Fed. Rep. of Germany ..... 263676
May 26, 1977 [DE] Fed. Rep. of Germany ..... 272380

[51] Int. Cl.[2] ..... B24B 1/00; B24B 37/04

[52] U.S. Cl. ..... 51/133; 51/263; 51/281 SF

[58] Field of Search ..... 51/120, 131 R, 133, 51/165.88, 263, 267, 281 R, 281 SF, 317, 292, 134, 126, 129, 131 A, 131 B, 131 C, 131 D

[56] References Cited

U.S. PATENT DOCUMENTS

| | | | |
|---|---|---|---|
| 1,577,137 | 3/1926 | Maynard | 51/133 |
| 1,689,950 | 10/1928 | Leonard | 51/134 |
| 2,765,592 | 10/1956 | Krug | 51/134 |
| 2,998,679 | 9/1961 | Mattison | 51/126 |
| 3,793,779 | 2/1974 | Perrella | 51/134 |
| 3,872,626 | 3/1975 | White | 51/129 |
| 4,048,763 | 9/1977 | Janssen | 51/281 SF |

FOREIGN PATENT DOCUMENTS

| | | | |
|---|---|---|---|
| 497962 | 1/1939 | United Kingdom | 51/131 |
| 159431 | 10/1962 | U.S.S.R. | 51/133 |

*Primary Examiner*—Nicholas P. Godici
*Attorney, Agent, or Firm*—Steinberg & Blake

[57] ABSTRACT

A surface grinding method and apparatus wherein workpieces are ground with a ring-shaped grinding wheel having a ring-shaped grinding surface the inner diameter of which is relatively large with respect to the dimensions of the workpieces. The method and apparatus include steps and structure for providing between the workpieces and the ring-shaped grinding wheel a relative movement where the workpieces travel along a substantially cycloidal path with each workpiece having a point at the surface thereof which is ground by the grinding wheel and passes at least twice across the grinding surface between the outside and the inside thereof. To bring about this relative cycloidal movement, the central axis of either of the work-supporting structure or the grinding structure, preferably the work-supporting structure, is displaced around an axis which is parallel to its central axis, while this central axis is simultaneously moved inwardly toward and outwardly away from the axis parallel thereto.

31 Claims, 11 Drawing Figures

FIG. 1
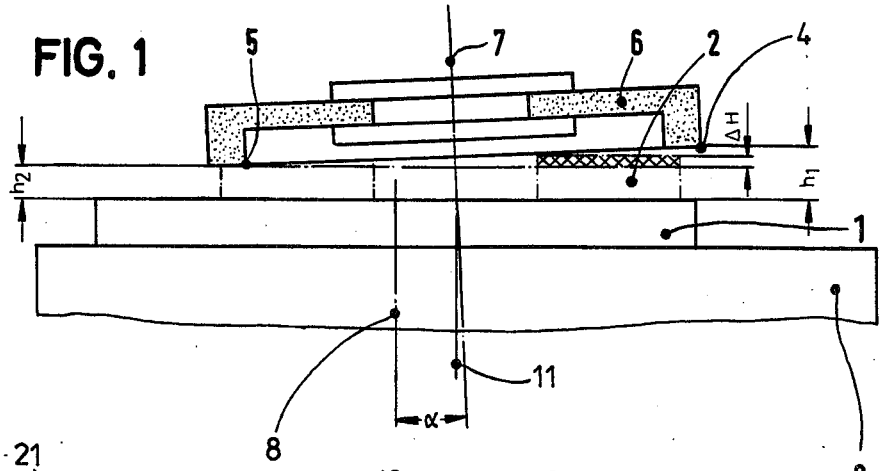
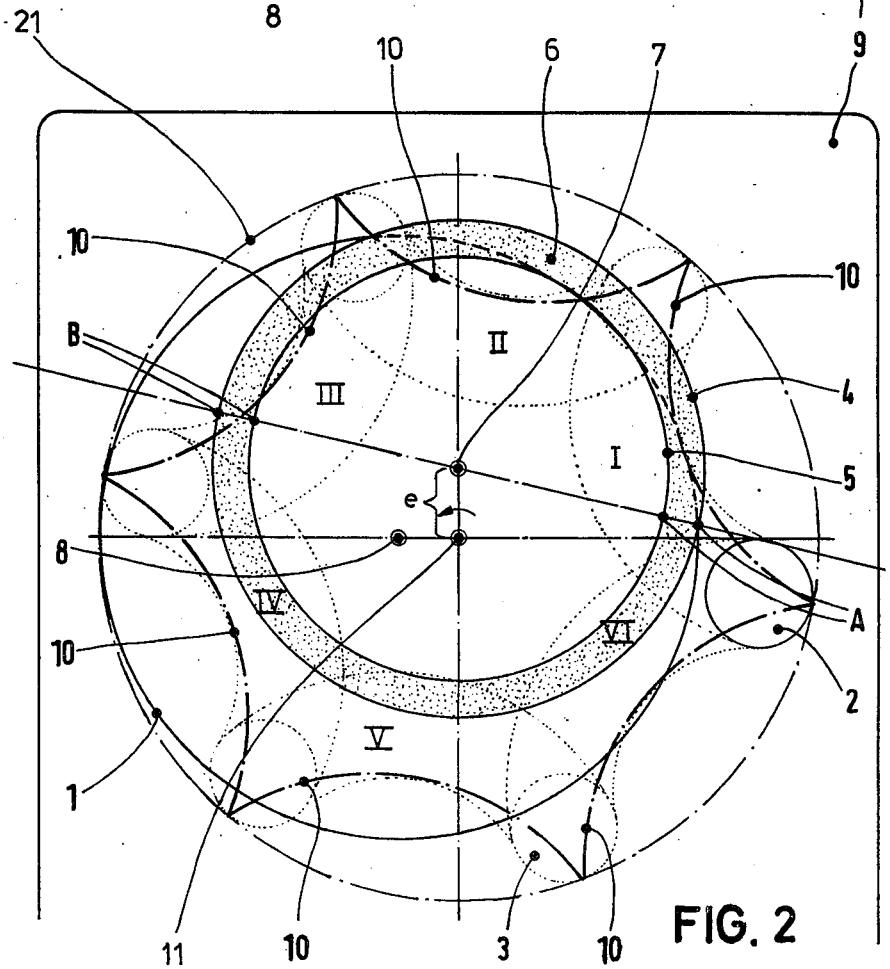
FIG. 2

FIG. 5
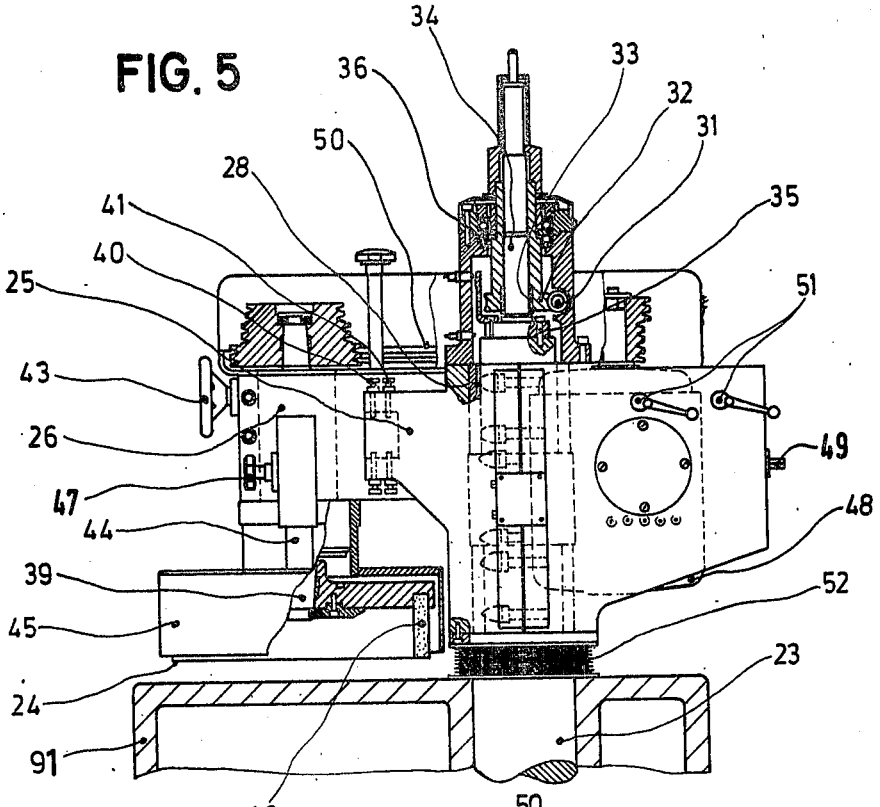
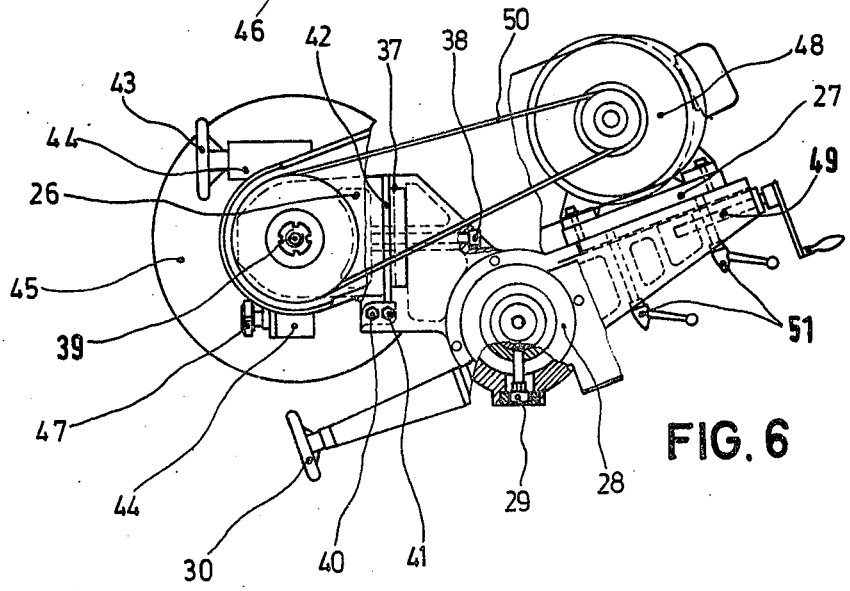
FIG. 6

SURFACE-GRINDING METHOD AND APPARATUS

BACKGROUND OF THE INVENTION

The present invention relates to surface-grinding of workpieces.

In particular, the present invention relates to methods and apparatus for surface-grinding workpieces with a ring-shaped grinder having a ring-shaped grinding surface the inner diameter of which is relatively large as compared with the dimensions of the workpieces.

With known surface-grinding machines of the above general type, for providing workpieces of the most varied materials with flat surfaces, it is customary to achieve the required degree of grinding by way of multiple adjustment of the grinding wheel with respect to the work, or adjustment of the work with respect to the grinding wheel, so that in this way it is possible on the one hand to achieve an accurate grinding and on the other hand to provide a precisely plane ground surface of desired smoothness at the work. Thus with conventional methods and apparatus the work is carried either by a longitudinally oscillating worktable or by a rotating circular worktable, such a worktable serving to hold the workpieces, while the feed of the grinding wheel and the work one with respect to the other is carried out after each reciprocation of a longitudinally moving worktable or after each revolution of a rotary worktable.

It is also known to provide surface-grinding machines where there is a combination of a longitudinally reciprocating and rotating worktable, with the rotary movement of the circular worktable being superimposed upon the straight-line reciprocation of the longitudinal table, the grinding wheel being carried by a carriage which is perpendicularly adjustable with respect to the direction of movement of the worktable.

Also, there are known surface-grinding machines where a ring-shaped grinding wheel has its axis situated at an inclination which is somewhat different from perpendicular to the worktable, on the one hand in order to reduce the power required during preliminary grinding with a relatively great cut, while on the other hand it is possible with such machines to provide cylindrical workpieces such as rings, discs, or cutting blades or the like with side surfaces which are inclined with respect to each other from the inside toward the outside. In addition it is already known to provide for workpieces whose outer dimensions are small with respect to the inner diameter of the ring-shaped grinding surface a movement on the circular or longitudinally movable worktable according to which the grinding surface is crossed twice by the workpiece at different locations of the grinding surface.

With the above conventional methods and apparatus a number of difficulties are encountered. Thus, with these conventional methods and apparatus the power required for bringing about the surface-grinding is excessively large while at the same time the time required for grinding workpieces is much too long. In addition, problems are encountered in maintaining the dimensions of the ground workpieces within predetermined tolerances. Also, the supply of cutting fluid to the workpieces while they are ground is provided in many cases only with considerable difficulty.

SUMMARY OF THE INVENTION

It is accordingly a primary object of the present invention to provide a method and apparatus according to which it becomes possible to bring about the required surface grinding while providing for grinding in a stepwise manner during an interval which requires no more than a single revolution of the worktable or the equivalent thereof.

A further object of the present invention is to provide between the ring-shaped grinding surface and the workpieces a relative movement which is the equivalent of one where the workpieces while in general moving along a circular path at the same time move substantially radially inwardly toward and outwardly away from the axis of the circular path so as to achieve between the grinding surface and the workpieces a relative movement similar to a cycloidal type of movement, thus achieving in this way a multiple-step grinding action without the complications involved in combining a rotary table with a longitudinally reciprocating table and without the complications involved in providing conveyer belts to hold and convey the workpieces while they are ground.

Yet another object of the present invention is to provide a method and apparatus according to which it becomes possible to achieve precisely ground surfaces of predetermined smoothness with the dimension of the ground workpiece being maintained within predetermined tolerances in a highly accurate manner.

It is furthermore an object of the present invention to provide for an effective supply of cutting fluid to workpieces which move along cycloidal paths of the type referred to above.

Furthermore it is an object of the present invention to provide methods and apparatus capable of utilizing the principles of the present invention either in a continuously operating machine where finished pieces and pieces which are to be ground can be removed from and added to the machine while the grinding continues, or in a discontinuously operating machine where the machine operation is interrupted after a group of workpieces have been ground to the desired extent.

Yet another object of the present invention is to provide a method and apparatus for bringing about either a large amount of grinding or the grinding of workpieces made of materials which are difficult to grind with this discontinuous type of method and apparatus of the invention, in a highly effective manner.

According to the invention, the ring-shaped grinding means and a work-support means form a pair of means one of which, preferably the grinding means, is simply rotated about its own central axis, while the other of the pair of means, preferably the work-support means, has a central axis which is displaced around a third axis which is parallel to this central axis while simultaneously moving inwardly toward and outwardly away from this third axis so that the workpieces which are carried by the work-support means at a location spaced outwardly from its central axis all carry out a cycloidal type of movement. All known types of cyloidal movements such as epicycloidal or hypocyclloidal movements are included with the invention, with the number of cycloidal movements which are effected during a single revolution being determined by the relationships between the components of the transmission which provides this cycloidal type of movement.

With the invention during each revolution of the worktable one or more workpieces will travel across the grinding surface of the ring-shaped grinder a number of times so that when the grinding surface is inclined with respect to the table without any feeding requirement it is possible to bring about the total desired degree of grinding in a multiplicity of steps in an extremely short time at each workpiece. Thus, each workpiece during one revolution of the worktable will progress further and further toward the location where the space between the grinding surface of the grinding ring and the worktable becomes a minimum. Thus at each pass of a workpiece across the ring-shaped grinding surface of the grinding wheel, additional material will be ground away until, when the workpiece travels through the location where the distance between the worktable and grinding surface of the grinding wheel are at a minimum, the grinding is completed and the workpieces can, for example, be continuously removed while additional workpieces which are to be ground can be supplied.

Furthermore, the above cycloidal type of movement of the invention lends itself to achieving a particularly high grinding output in the case where the axis of the grinding ring is perpendicular to the worktable and a continuous feed of the grinding ring is provided at relatively high speed while the grinding wheel simultaneously works on a number of workpieces inasmuch as with such an arrangement the workpieces continuously travel across the ring-shaped grinding surface of the grinding wheel in rapid sequence.

BRIEF DESCRIPTION OF DRAWINGS

The invention is illustrated by way of example in the accompanying drawings which form part of this application and in which:

FIG. 1 is a schematic elevation of one possible method and apparatus of the present invention;

FIG. 2 is a schmatic plan view of the embodiment of FIG. 1;

FIG. 5 is a sectional elevation illustrating how the grinding wheel is mounted and driven;

FIG. 6 is a top plan view of the structure of FIG. 5;

DESCRIPTION OF PREFERRED EMBODIMENTS

Figure 3:
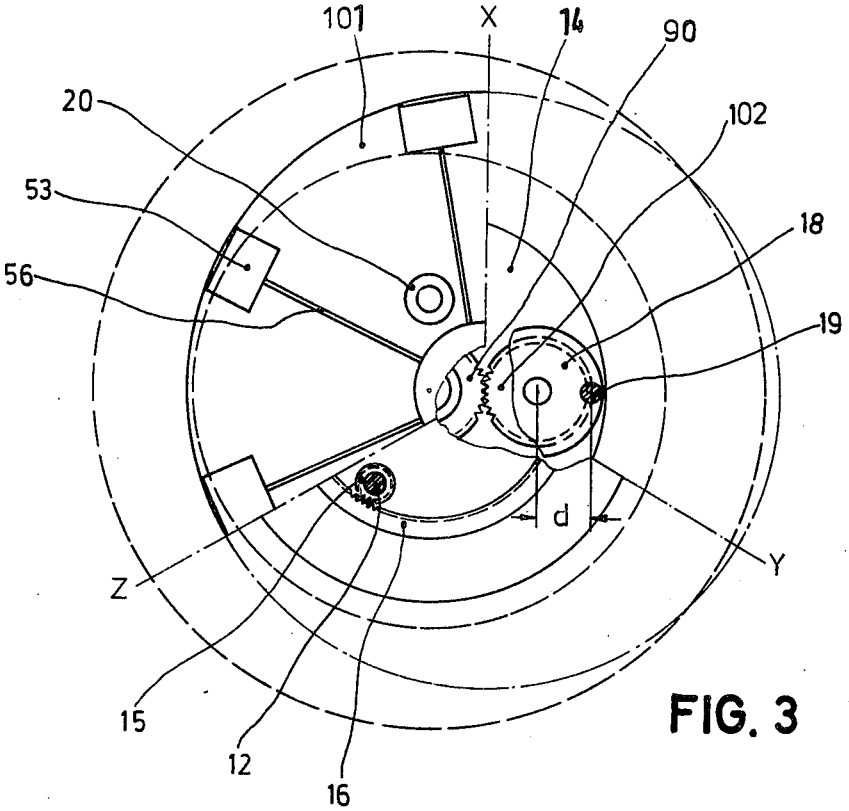
FIG. 3 is a schematic plan view of one possible structure of the invention with different portions of FIG. 3 being taken in different planes of FIG. 4.

Referring to FIGS. 1 and 2, there is schematically illustrated therein a driven rotary worktable 1 which is guided and supported for movement by a machine frame 9 in such a way that at each revolution the table 1 travels along an endless cycloidal path 10 shown in FIG. 2. During the travel of the rotating worktable 1 along the cycloidal path 10, the central axis 8 of the worktable 1 is displaced around a second axis 11 which is parallel to the axis 8. This axis 11 at the same time contains the center of a circular path 21 along which the outer periphery of the table 1 travels. The workpieces 2, 3, etc. which are held by the rotary worktable 1 on the other hand move along the cycloidal paths I–VI indicated by the dotted lines in FIG. 2. The rotary grinding means 6 is driven about its own central axis 7 and includes a downwardly directed ring-shaped grinding surface having an outer peripheral edge 4 and an inner peripheral edge 5. This central axis 7 of the rotary grinding means 6, and thus the bottom ring-shaped grinding surface thereof are inclined so that the axis 7 forms the angle $\alpha$ with respect to the axis 8, as indicated in FIG. 1. Thus, along the peripheral edges 4 and 5 of the grinding surface from the points A to the points B indicated in FIG. 2, through an angular distance of one half of the ring-shaped grinding surface the inclination of the grinding means with respect to the table 1 is such that the distance between the bottom grinding surface and the upper surface of the worktable 1 changes from a maximum of $h_1$ to a minimum of $h_2$ (FIG. 1), and the difference $h_1-h_2$ therebetween corresponds to the total grinding cut $\Delta H$.

As is furthermore apparent from FIG. 2, the central axis 7 of the rotary grinding means is displaced from the axis 11 of the envelope 21 by the distance e.

Thus, with the illustrated arrangement the cycloidal paths IV, V and VI situate the workpieces outwardly beyond the grinding wheel so that the workpieces 2, 3, etc. can be continuously removed from the worktable and supplied thereto, while the actual grinding takes place along the cycloidal paths I, II, and III. As is apparent from FIG. 2, at these paths I–III a point on each workpiece will travel a number of times across the grinding surface of the grinding means 6.

FIG. 2 illustrates by way of example the path 10 for the table 1 which will provide for the workpieces the abovedescribed six cycloidal arcs. It is further to be understood that according to the invention it is possible to provide for any type of favorable path of movement for the workpieces according to all known types of cycloidal paths. Also it is possible according to the invention to arrange the axes 7 and 11 so that they are at least approximately in coincidence.

The details of a structure which operates according to the method and apparatus shown in FIGS. 1 and 2 are illustrated in FIGS. 3–6. The structure shown at the upper right of FIG. 3 between the radial dot-dash lines X and Y is taken along the section A-B of FIG. 4. The structure shown at the lower part of FIG. 3 between the dot-dash radial lines Y and Z is taken along the section line C-D of FIG. 4, while the structure shown at the upper left of FIG. 3 between the radial dot-dash lines X and Z is a top plan view of the structure of FIG. 4.

Figure 4:
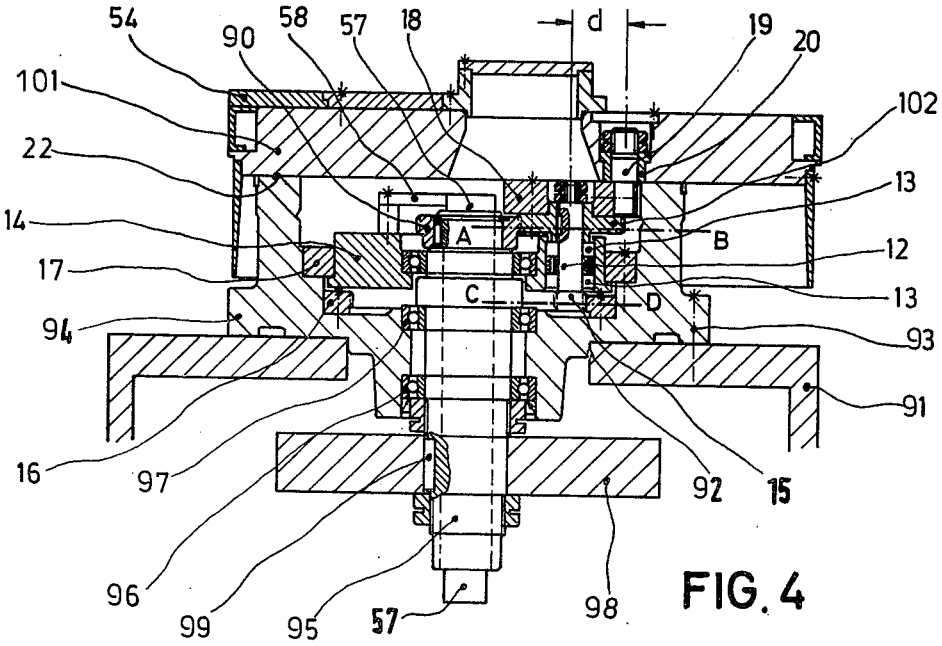
FIG. 4 is a sectional elevation of the structure which is shown in FIG. 3.

Referring now to FIGS. 3 and 4, the complete circular table unit of FIG. 4 is carried by a machine frame 91, which corresponds to the frame 9 shown in FIG. 1. Thus, the bed 94 of the machine is fixed at the location 92 on the frame 91 by way of the schematically illustrated bolts 93. The bed 94 supports for rotary movement, by way of suitable ball bearings 96 and 97 a rotary input shaft 95 of a cycloidal drive means which is operatively connected with the rotary worktable 101 which corresponds to the table 1 of FIGS. 1 and 2. This rotary input shaft 95 is driven about its axis by way of a suitable pulley 98 which is fixed by a key 99 to the shaft 95 and which is driven by a belt from any suitable motor, transmission, or the like.

The rotary input shaft 95 of the cycloidal drive means fixedly carries at its end region distant from the pulley 98 a sun gear 90 which meshes with three planetary gears 102 which remains at all times in mesh with the sun gear 90. The several planetary gears 102 are respectively fixed to shafts 12 which are supported for rotation by way of suitable ball bearings 13 carried by an annular means 14 in the form of a ring which is supported for free rotary movement on the bed 94. The ends of the shafts 12 distant from the planetary gears 102 fixedly carry pinions 15. These pinions 15 remain in mesh with and ride along the inner teeth of an internal ring gear 16 which is fixed to the bed 94 so as to remain stationary. The rotary annular support means 14 for the planetary gears is radially and axially supported by way of a circular slide ring 17 which is fixed to the bed 94. The several planetary gears 102 have eccentric discs 18 fixed thereto and these discs 18 respectively carry crank pins 19 which are received in the openings 20 of the rotary worktable 101, these openings 20 being provided with suitable needle bearings for the crank pins 19. Thus the eccentric discs 18 may be considered as forming part of the planetary gears which thus carry the crank pins which are spaced from the axes of the shafts 12 and which are received in openings of the worktable 101.

Assuming now that the input shaft 95 is driven by way of the pulley 98, this rotation of the shaft 95 is transmitted to the sun gear 90 which in turn rotates the three planetary gears 102, thus causing the eccentric discs 18 and the crank pins 19 to rotate around the axes of the shafts 12. Thus, by way of the crank pins 19 the circular worktable 101 is driven while being slidably supported at the top surface 22 of the bed 94. Thus, if it is assumed that the pinions 15 are not present, it will be seen that the worktable 101 is translated by way of a circular movement. This circular translational movement has the radius d indicated in FIGS. 3 and 4. Thus, during this type of movement the central axis of the worktable is translated while remaining parallel to itself but does not rotate.

However, at the same time by way of the shafts 12 the pinions 15 ride along the internal ring gear 16, with the annular support means 14 and of course the table 101 rotating slowly according to the transmission ratio determined by the number of pinion teeth divided by the number of teeth of the gear 16. This superimposing of the circular translational movement having the radius d and the relatively slow rotary movement of the annular planetary ring 14, which turns according to the above transmission ratio, provides for the required cycloidal movement of every point at the upper surface of the worktable 101, in accordance with the invention. Thus, depending upon whether the gear 16 is an internal ring gear, as illustrated, the cycloidal arcs will have outside relatively sharp reversing points, or in the case where a ring gear having exterior teeth is utilized the cycloidal arcs will have interior sharp reversing points. The stroke or radial dimension of each cycloidal arc is determined by the distance d. The number of cycloidal arcs is determined by the relationship between the number of teeth of the gear 16 and the number of teeth of each pinion 15, and the path travelled by the tips or ends of the cycloidal arcs is determined by the diameter *2d* divided by the diameter of the pitch circle of the pinions, so that by controlling these factors the particular movement which is achieved can be varied. Thus, in the event that the pitch diameter of each pinion is equal to the diameter *2d*, relatively sharp reversal points will be provided, while when this diameter *2d* is greater than the pitch diameter of the pinions, the cycloidal curves will have reversing loops.

The pair of parallel rotation axes are determined by way of the pinion shafts 12, the curvature of the cycloidal arcs, and the path of travel thereof, while the axis of the rotary input shaft 95 forms the equivalent of the axis 11 of FIGS. 1 and 2, this axis being situated at the center of the inner and outer envelopes along which the cycloidal curves are arranged.

Referring now to FIGS. 5 and 6, the entire grinding wheel unit, including the driving motor thereof, is carried by a relatively massive column 23 which is supported by the base 91 of the machine in such a way that the elevation of the column 23 can be adjusted with respect to the base or frame 91. This column 23 with the entire grinding wheel assembly can be hydraulically raised and lowered and clamped at any desired adjusted elevation so that the distance of the lower ring-shaped grinding surface 24 from the surface of the worktable can be adjusted in a coarse manner in this way. The grinding wheel assembly includes the guide structure 25 carried by the column 23, the outwardly extending arm 26 which carries the spindle of the grinding wheel, and the adjusting unit 27 for the driving motor. The bearing which supports the grinding wheel assembly on the column includes the guide sleeves 28 which are supplied with specially profiled rollers which are adapted to the diameter of the column 23 and the bores of the sleeves 28. One guide roll 29 (FIG. 6) is carried by a pin projecting radially from the column 23 and is received in a suitable opening of the guide sleeve structure 28 for preventing rotation of the entire grinding wheel assembly around the column 23. However, by way of the guide sleeves 28 it is possible for the entire grinding wheel assembly to be adjusted along the column 23 with substantially no play or friction in an extremely fine manner, so that it is possible through such an adjustment to change the elevation of the grinding wheel assembly with respect to the fixed column 23. This fine adjustment is carried out by way of a hand wheel 30 which is connected with a worm 31 so as to rotate the latter, this worm 31 meshing with a worm wheel 32 to provide an extremely large transmission ratio. Thus, a relatively large number of rotations of the worm 31 are required for a single rotation of the worm wheel 32. This worm wheel 32 is provided with inner threads 33 which are threaded onto mating threads of a bar 34 which is coaxially fixed to the column 23 by way of the bolts 35.

As is apparent from the upper portion of FIG. 5, the worm wheel 32 has an integral upwardly extending coaxial tubular extension which carries an axial thrust ball bearing 36 on which the entire grinding wheel assembly is supported. Thus, in accordance with the particular direction in which the handle 30 is turned, the worm wheel 32 will turn itself in one direction or the other along the spindle 34 with the extent of axial movement of the worm wheel being suitably limited, so that with such an arrangement by way of the bearing 36 the elevation of the grinding head can be adjusted. In this way it is possible to achieve an extremely accurate fine adjustment in micrometer increments so that in this way it is possible to provide the required extent of grinding for the workpieces or to compensate for wear.

The outwardly extending arm 26 of the grinding wheel assembly supports for rotary movement the spindle of the grinding wheel itself, and this arm 26 is supported by a bearing 37 at the guide 25. Screws 38 serve to fix the arm 26 in an adjusted angular position. The inclination of the rotary spindle or drive shaft 39 of the grinding ring 46 with respect to the worktable or in other words with respect to the column 23 can be brought about by way of the centering collar 37 which forms part of a sphere as pointed out above. For this purpose the screws 38 are loosened and adjusting screws 40 are operated so as to provide for the axis of the shaft 39 a position according to which it is precisely parallel to the axis of the column 23 or slightly inclined with respect thereto within a limited range, these screws 40 providing for an adjustment which is perpendicular to the plane of FIG. 5. In other words the arm 26 has between the upper and lower screws 40 a projection which when these screws 40 are turned in a given direction will provide for tilting of the arm 26 and the grinding wheel structure carried thereby about an axis which is horizontal and passes through the center of the bearing 37. A second pair of adjusting screws 41 are provided for adjusting a spacer disc 42 which is situated between the partly spherical centering collar 37 and the arm 26. This adjusting plate 42 is of a slightly conical configuration so that in response to adjustment by the screws 41 this plate 42 will bring about a tilting of the arm 26 and the structure carried thereby in the plane of FIG. 5. A pair of opposed screws 40 as well as a pair of opposed screws 41 are provided for checking purposes as well as for convenience in bringing about adjustments in opposite directions.

The hand wheel 43 carried by the arm 26 serves to rotate an adjusting spindle 44 to bring about a slight adjustment of the protective hood 45, in particular adjusting the hood 45 with respect to the elevation of the grinding ring 46. A manually engageable element 47 is accessible for releasably fixing the position of the protective hood 45.

The driving motor 48 for the grinding ring is carried by an adjusting unit 27 which is mounted on the guide 25. By way of the adjusting spindle 49 the motor can be shifted so that the proper tension can be maintained in the driving belt 50 which serves to transmit the drive by way of suitable pulleys from the motor 48 to the spindle 39. The carriage which carries the motor 48 and which is adjusted by way of the spindle 49 can be fixed in an adjusted position by way of the fixing bolts 51. The column 23 is protected against damage and contact by foreign particles, dirt, or the like, by way of a suitable flexible bellows 52.

Figure 7:
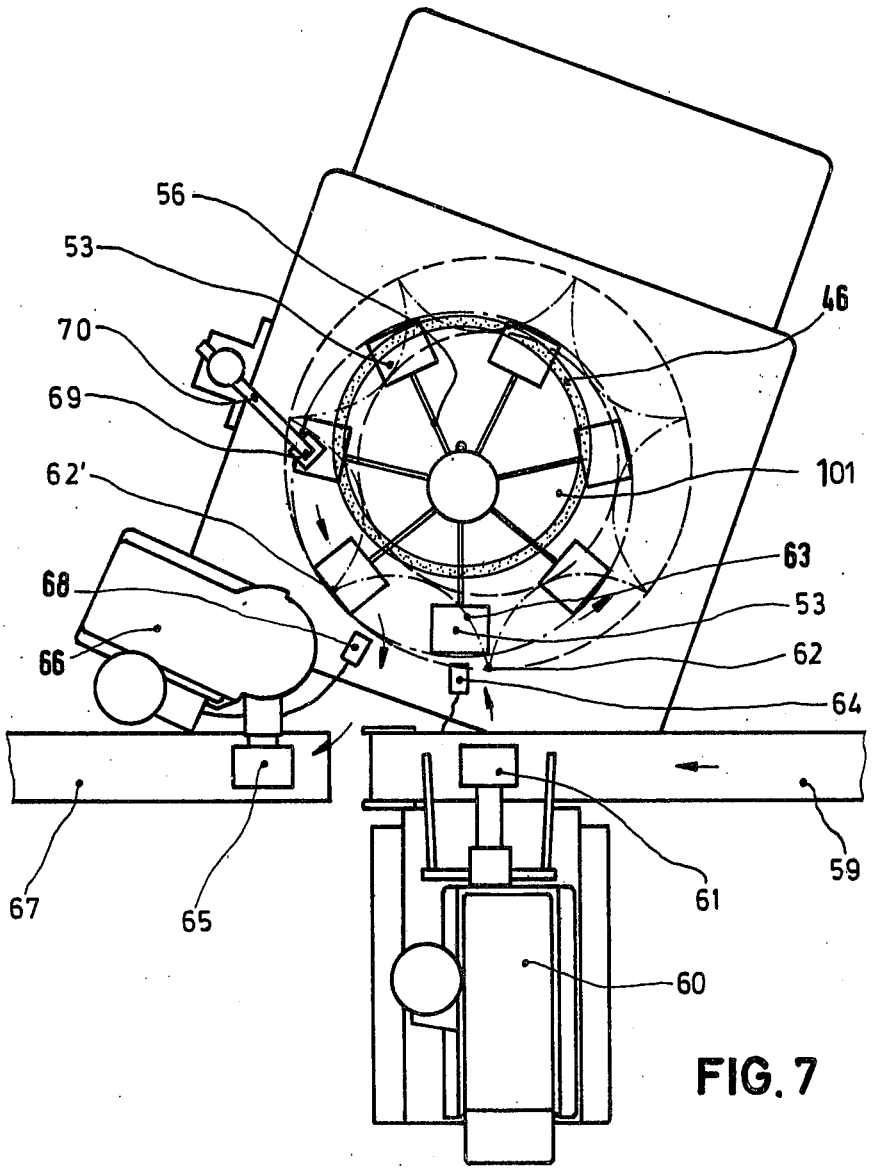
FIG. 7 is a schematic top plan view illustrating the method and apparatus of the invention particularly with respect to automatic feeding and removal of workpieces as well as with respect to automatic detection of the dimensions of the ground workpieces.
Figure 8:
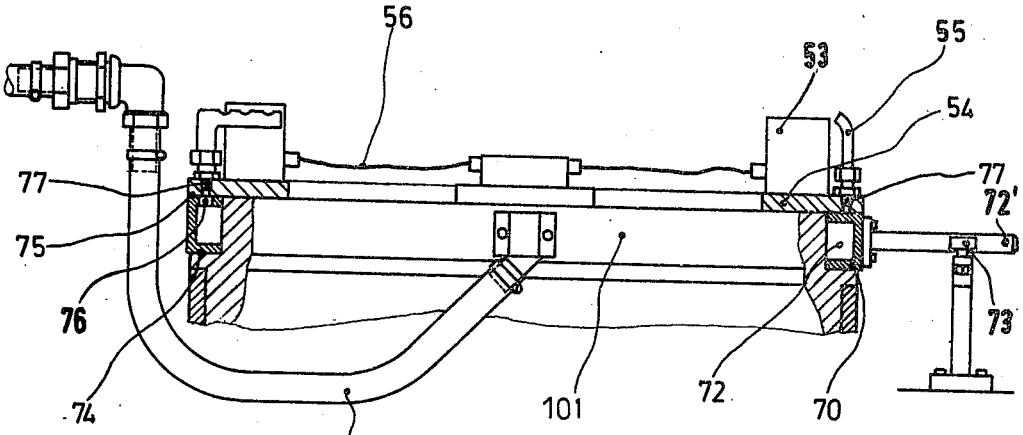
FIG. 8 is a partly sectional schematic elevation of the manner in which a cutting fluid is supplied.
Figure 9:
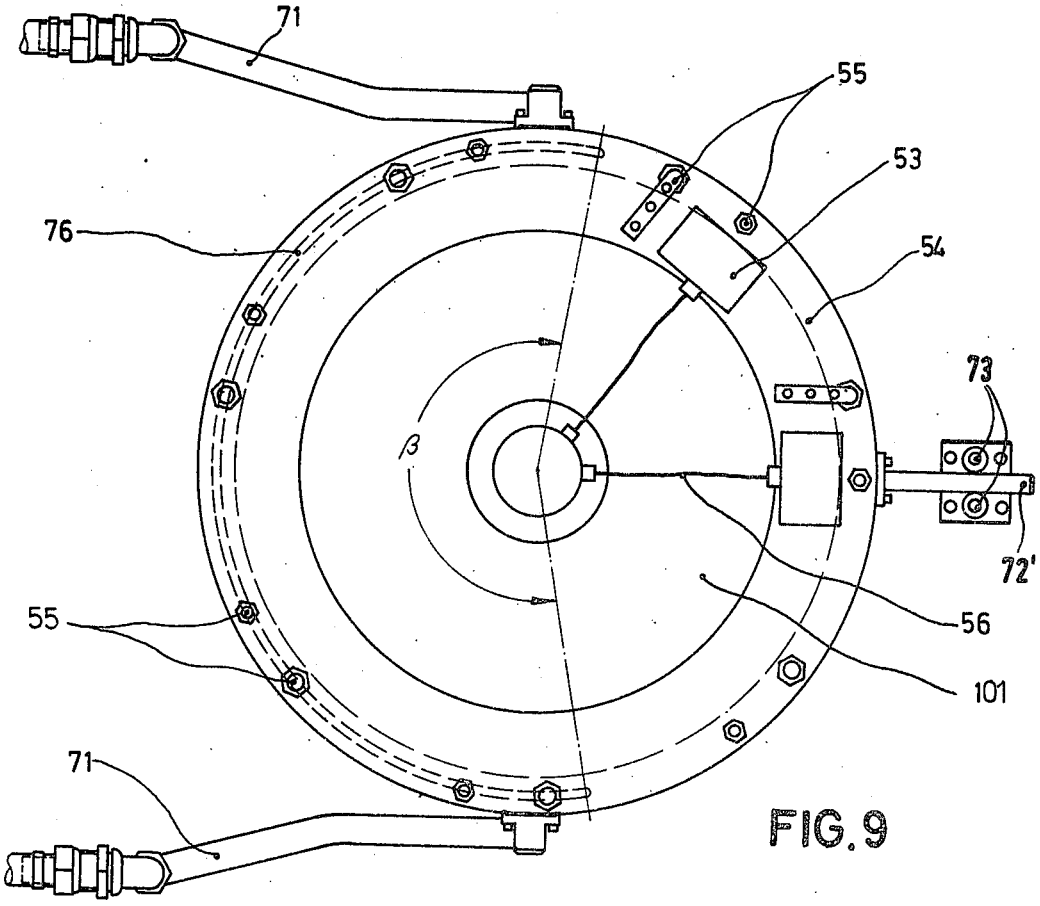
FIG. 9 is a schematic top plan view of the arrangement shown in FIG. 8.

Referring now to FIGS. 7–9, it will be seen that the worktable 21 carries a number of individual workpiece-holding units 53, preferably in the form of magnetic holding blocks, the latter being carried by a common mounting ring 54 for the purpose of quickly preliminarily mounting and exchanging the work-holding units 53. The upper surfaces of the several work-holding magnets 53 are situated at such an elevation that the workpieces carried thereby all extend at their upper surface regions which are to be ground upwardly beyond all other parts carried by the worktable such as, for example, the cooling or cutting fluid supply pipes or nozzles 55. In this way the surfaces which are to be ground will have an unhindered passage beneath the grinding ring. The several holding magnets are controlled in a manner according to the zone they occupy. Thus, as may be seen from FIG. 4, a slip ring unit is carried by the upper free end of a guide pipe 57 which extends upwardly beyond the rotary input shaft 95 along the hollow interior thereof, this pipe 57 being spaced inwardly from the inner surface of the shaft 95 so as to be out of engagement therewith. This slip ring unit provides the controlled connection between the electromagnets 53 and the supply of current thereto by way of the conductors 56. The electrical control structure is such that the electromagnets are energized and hold the workpieces while they are in engagement with and are being ground by the grinding ring, while at the loading and unloading zones for the workpieces the units 53 are not energized so that the workpieces are free to be removed and added. The conductors 56 are guided through the pipe 57 which of course does not engage the input shaft 95. The length of the conductors is such that without any tension therein they can follow the eccentric stroke *2d*. The guide pipe 57 is fixed by way of one or more arms 58 to the annular slide ring 14 which carries the planetary gears, so that the arms 58 together with the pipe 57 follow the circular movement of and travel with the ring 14. Thus all of the conductors travel slowly along a circular path together with the ring 14 and thus follow the slow rotation of the worktable about the axis 11 of the input shaft 95.

FIG. 7 illustrates schematically by way of example an automatic loading and unloading arrangement. The workpieces are supplied by way of a suitable conveyer belt 59 to the loading unit 60. This loading unit 60 has a work-gripping member 61 capable of picking up a workpiece and moving the same to a location situated over the worktable 101. The loading and unloading unit is arranged in such a way that the gripping arm 61 comes to rest precisely over one of the reversing locations 62 of the cycloidal path. As a workpiece holding unit 53 approaches along the cycloidal path 63 the reversing point 62, a switch 64 is actuated by engagement with the particular unit 53 which approaches the reversing point 62, providing in this way a signal which is transmitted to the outwardly extending gripper arm 61, this signal providing for release of the workpiece by the gripper 61. The workpiece then falls onto the holding magnet 53 which is situated just beneath the falling workpiece, and after a short extent of turning of the table 101, before the workpiece moves beneath the grinding ring the magnet is energized for reliably holding the workpiece during the grinding thereof. This holding action of the magnets is maintained until the workpiece has been ground through a number of steps and travels beyond the region of the grinding ring 46. Then the magnetic holding member 53 has its polarity reversed for a short time and becomes unenergized. The ground workpiece is now free and can be taken up by the inwardly swinging gripping arm 65 of the unloading unit 66, this arm 65 returning to deposit the finished workpiece on the conveyer belt 67 which in turn transports the completed work away from the machine. The signal for removing a finished workpiece is provided at the reversing point 62' of the cycloidal path by way of a switch 68 which in the same way as the switch 64 serves to control the position of the table 101.

FIG. 7 also illustrates the input or sensing element 69 of an automatic measuring unit. Beneath the feeling or sensing element 69, which is carried by an arm 70 which is mounted on the machine frame, the ground surface of a workpiece slides after leaving the grinding range of the grinding ring 46. Thus, the previously adjusted feeler 69 detects the height of the finished workpiece and transmits a measuring signal to a corresponding amplifier. At this amplifier a comparison is made as to whether or not the measurement is within the desired tolerance limits. If it is determined that the workpiece, because of wear of the grinding ring, is too high, so that the maximum tolerance limit is exceeded, then an adjusting motor receives a signal, and this adjusting motor drives the worm 31 of FIG. 5 so as to bring about a fine adjustment of the grinding ring. Thus when the feeler 69 detects that the maximum tolerance limit has been exceeded, this adjusting motor is energized so as to drive the worm 31 and adjust the elevation of the grinding wheel until a workpiece ground thereby has been ground almost to the minimum tolerance limit, and then in response to a suitable signal the adjusting motor is turned off.

A further feature of the method and apparatus of the invention is illustrated in FIGS. 8 and 9. Because of the cycloidal type of movement of the circular worktable, it is not possible to provide for flow of the cutting or cooling fluid from stationary nozzles to the region where the grinding ring and workpieces engage each other. In order to eliminate this latter disadvantage, the cutting fluid supply of the invention shown in FIGS. 8 and 9 in particular has been provided. Thus, it will be seen that the rotary worktable 101 carries a hollow channel means 70 which slidably engages the worktable 101 along the periphery thereof. Thus the circular channel 70 can move slidably with respect to the table 101. The cooling or cutting fluid is supplied by way of one or more flexible hoses 71 which communicate with the hollow interior 72 of the channel 70 so as to provide the hollow interior 72 of the ring 70 constantly with a supply of cooling or cutting fluid which is under pressure. The ring 70 is fixed to the inner end of a horizontal guide rod 72' which extends between and is guided by a pair of rollers 73 which are supported for free rotary movement by a suitable bracket structure mounted on the base of the machine. Thus, the rollers 73 prevent the rod 72' and the ring 70 from turning with the table 101 while at the same time it is possible for the rod 72' and the ring 70 to follow the translational radial movement of the table 101. Thus, the channel means 70 can follow the pendulum type of movement of the worktable while remaining connected with the supply hoses 71. The ring 70 has slide surfaces 74 and 75 with respect to the worktable 101 and the ring 54 which carries the work-holding units 53. These slide surfaces 74 and 75 between the channel means 70 and the table 101 and mounting ring 54 form at the same time the sealing surfaces which prevent undesired escape of the cutting fluid.

The channel means 70 is formed at a portion which slidably engages the mounting ring 54 with a series of openings or with a single elongated arcuate slot 76. This slot 76 is in alignment with the inlet bores 77 of the cutting fluid nozzles 55 which are carried by the ring 54. The slot 76 extends through the angle $\beta$ which is shown in FIG. 9, and this angle corresponds approximately to the grinding region where the workpieces are engaged by the lower surface of the grinding ring. Thus, as the several nozzles 55 turn together with the ring 54 and the worktable, the lower inlet openings 77 of the nozzles 55 will come into communication with the slot 76 to receive therethrough cooling or cutting fluid only at the time when the workpieces are actually in engagement with the grinding ring. At these times the cutting fluid can flow from the channel 70 and through the inlet openings 77 out through the nozzles 55 until the latter moves beyond the slot 76, at which time the workpieces have travelled beyond the grinding zone. The nozzles 55 mounted on the ring 54 are arranged in such a way that even though they also perform the cycloidal type of movement nevertheless they provide constantly an unchanged optimal cooling at the grinding location. At the loading and unloading regions of the surface grinding machine there is no passage from the channel means 70 so that there is no supply of cutting fluid from the nozzles at the loading and unloading location, and thus a highly favorable loading and unloading without the presence of any cutting fluid is created.

Figure 10:
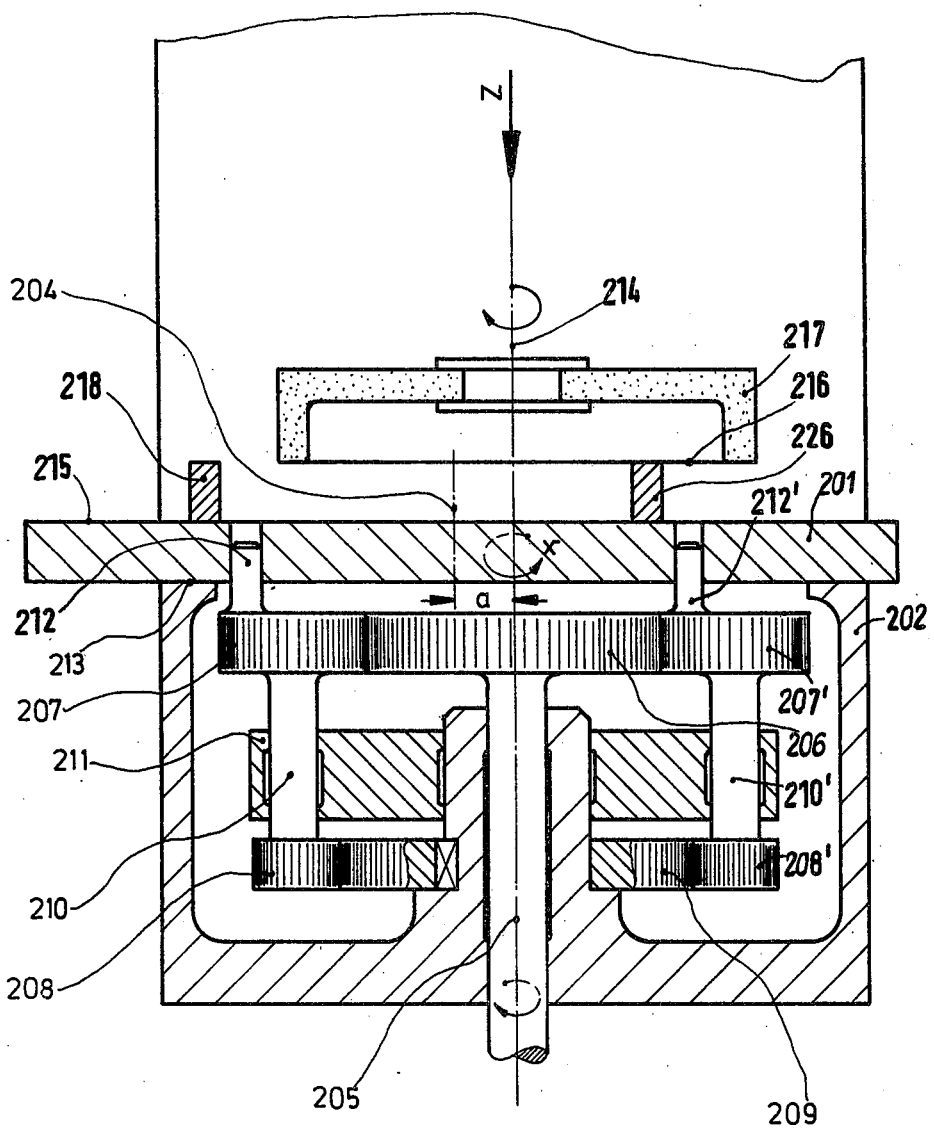
FIG. 10 is a schematic sectional elevation of a further embodiment of the invention.
Figure 11:
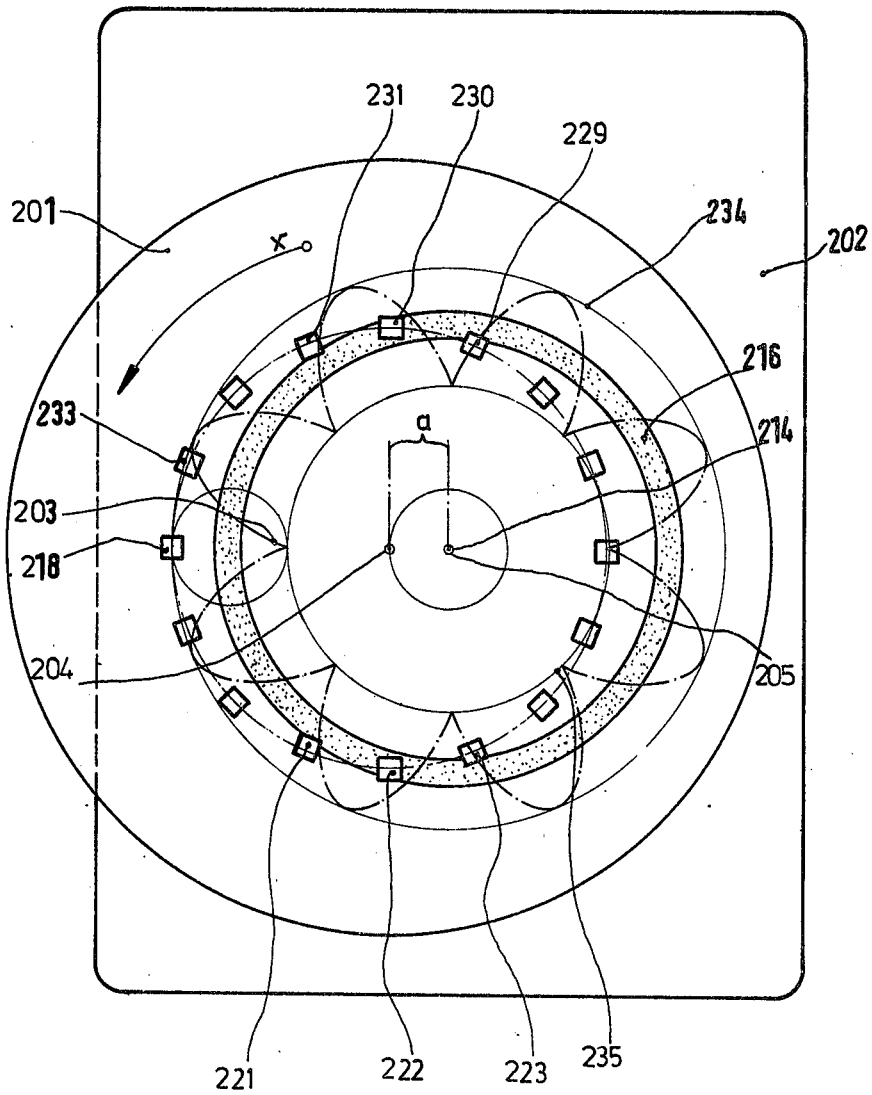
FIG. 11 is a schematic plan view of the arrangement shown in FIG. 10.

A further embodiment of the invention is illustrated in FIGS. 10 and 11. This embodiment operates in a discontinuous manner in the sense that the grinding ring operates with continuous feed thereof whereas with the above-described embodiment there is a continuous passage of the workpieces beneath the inclined grinding ring but without any constant feed thereof. Thus, the discontinuous type of operation for the embodiment of FIGS. 10 and 11 signifies that the rotary worktable is turned off and stationary when part of the workpieces are supplied, and then these workpieces rotate until they are ground to the desired extent and then the operation of the machine is again terminated and the grinding wheel is moved away from the worktable while the latter is stationary so that the finished pieces can be removed. This cycle is again repeated, and through the repetitions of these cycles the discontinuous method and apparatus of FIGS. 10 and 11 operates.

Thus, with the embodiment of FIGS. 10 and 11, it is possible to achieve an operation according to which the workpieces, which have small dimensions with respect to the inner diameter of the grinding ring, either have a large amount of material ground away therefrom or they are made of a material which is very difficult to cut, so that in both of these cases it is possible to achieve with the embodiment of FIGS. 10 and 11 the relatively great output for grinding the workpieces. In order to achieve this high grinding output in an economical manner the grinding operation must be carried out in an optimal manner, which is to say the grinding time is relatively short as compared with previously known times required for conventional surface grinders to carry out similar operations. With the embodiment of FIGS. 10 and 11, at each rotation of the worktable each workpiece is ground during travel along at least a pair of cycloidal paths, so that an extremely high grinding output is achieved during each rotation of the worktable.

With the embodiment of FIGS. 10 and 11, the axis of the grinding ring is parallel to the central axis of the worktable while the grinding wheel can be fed toward the worktable. In this case also, however, the central axis of the worktable is displaced around an axis which is parallel thereto while at the same time moving inwardly toward and outwardly away from this axis which is parallel to the worktable axis, so as to provide also the cycloidal type of movement referred to above. In this way it is possible for the workpieces during a revolution of the worktable to cross beneath the grinding surface of the grinding ring a number of times.

Referring now to FIGS. 10 and 11, the rotary worktable 201 is supported for rotation by and guided with respect to the machine frame 202 in such a way that during rotation the table 201 moves along the cycloidal path 203 indicated in FIG. 11. The central axis 204 of the table 201 is situated at the distance a from a second axis 205 which is parallel to the axis 204. This axis 205 forms the axis of rotary input shaft which corresponds to the shaft 95 of FIG. 4 and which is driven in the same way. The input shaft fixedly carries at its upper end a sun gear 206 which meshes with at least three planetary gears 207 and 207′ which respectively fixedly carry the crank pins 212 and 212′. The gears 207 and 207′ are respectively fixed to shafts 210 and 210′ which are fixed at their lower ends to pinion 208 and 208′, these shafts 210 and 210′ being guided for rotation in suitable openings of the rotary ring 211 which is supported for rotation by the machine frame 202 in the manner most clearly shown in FIG. 10. The pinions 208 and 208′ are situated outside of and mesh with the external teeth of an external ring gear 209 which is fixed to the base 202 in the manner shown in FIG. 10. Thus, through this cycloidal drive means it is possible to provide for rotation of the table 201 in the direction of the arrow X indicated in FIG. 11. The frame has a flat surface 213 which guides the table 201 for movement.

The drive spindle which carries the grinding wheel 217 has a central axis 214 which can be moved by a feed means in the direction of the arrow N indicated in FIG. 10. This feed means may, for example, take the form of the worm and worm wheel drive referred to above. The axis 214 of the grinding means 217 is perpendicular to the surface 215 of the work-support means 201. Thus, the lower grinding surface 216 of the grinding wheel 217 is parallel to the worktable surface 215 so that the workpieces 218–233 which are held on the worktable always are ground to the same extent. Thus, in the illustrated example there are sixteen workpieces 218–233 held on the worktable for example by way of suitable magnets as described above and which are not illustrated in FIGS. 10 and 11. By way of the uniform distribution of the workpieces 218–233 on the surface 215 along a circle, the ring-shaped grinding surface 216 of the grinding means 217 is loaded in such a way that it always engages workpieces approximately at diametrically opposed parts of the grinding zone which are angularly spaced by 180° from each other. Thus, referring to FIG. 11 it will be seen that in the illustrated example the zone of the workpieces 221, 222, and 223 is diametrically opposed to the zone of the workpieces 229, 230, and 231, and these are the particular workpieces which are ground at the instant of operation illustrated in FIG. 11. In this way any moment arms which tend to tilt the grinding ring are practically completely eliminated. The grinding surface 216 of the grinding means 217 thus remains concentric with and approximately midway between the outer envelope 234 and the inner envelope 235, this outer envelope being determined by the reversing points of the cycloidal curves 203 while at the inner envelope is determined by the centers of the workpieces. Thus, the envelope 235 is determined by the distance of the workpieces from the axis 204. In this embodiment the axis 205 about which the axis 204 moves and the axis 214 of the spindle of the grinding wheel approximately coincide with each other.

Thus, with the above-described embodiment of FIGS. 10 and 11 it is possible to achieve by the single feeding of the single grinding wheel a simultaneous grinding away of the material from the workpieces to the desired extent so that when adjustment of the grinding wheel through the required feed increment is completed all of the workpieces will be ground to the same height inasmuch as the grinding surface of the grinding means is parallel to the surface of the worktable.

Inasmuch as several relatively small workpieces are simultaneously held by the worktable at a distance from the central axis thereof, it is possible to provide the above arrangement according to which a pair of diametrically opposed workpieces are arranged so as to be simultaneously engaged by the grinding surface of the grinding wheel while crossing this grinding surface. In this way it is possible to eliminate any tilting moments which might otherwise act on the grinding wheel. In this way it is possible to eliminate the normally encountered grinding pressure which acts at one side of the grinding wheel and provides an undesired bending moment on the spindle of the grinding wheel. This possibility of eliminating these tilting forces at the grinding wheel is independent of the diameter of the grinding wheel in the case where the ring-shaped grinding surface is always situated approximately midway between the outer envelope 234 and the inner envelope 235 referred to above and shown in FIG. 11. The cycloidal type of movement of the worktable with respect to the grinding ring achieves for the workpieces substantially radial strokes which are symmetrically arranged with respect to the ring-shaped grinding surface when the average diameter of the circle along which the workpieces are arranged is equal to the average diameter of the ring-shaped grinding surface. It will be seen that this relationship is present in FIG. 11. In this way it is possible to achieve the most favorable grinding conditions while at the same time it is possible to achieve, for a given stroke provided by the cycloidal paths and for a given width of the ring-shaped grinding surface, the grinding of the largest possible workpieces.

During the surface grinding operation with the embodiment of FIGS. 10 and 11 there prevails at the grinding surface of the grinding wheel, corresponding to the number of workpieces which are uniformly distributed, uniform axial grinding forces inasmuch as the diametrically opposed workpieces are simultaneously ground in a uniform manner. Thus the tendency of tilting forces to be transmitted to the grinding wheel at the location where the circular grinding surface engages the workpieces is eliminated and thus the spindle which is connected to the grinding ring operates in a much stronger and substantially stiffer manner while the grinding surface and the worktable maintain their parallel relationship independently of the grinding pressure.

Because of the rapid and frequent travel of the workpieces across the circular grinding surface of the grinding ring while the worktable rotates and carries out its cycloidal type of movement, with the simultaneous elimination of any tilting forces, the speed with which the grinding wheel is fed and the worktable rotated can be increased so as to achieve in this way an essential reduction in the time required for a given grinding operation without at the same time creating any disadvantageous influence on the smoothness of the surface which is ground.

What is claimed is:

1. In a surface-grinding method, the steps of arranging a plurality of workpieces along at least part of a circle on a work-support means which has a central axis, situating a ring-shaped grinding means at a location where a ring-shaped grinding surface thereof will engage the workpieces, said ring-shaped grinding surface having an inner diameter which is relatively great with respect to the dimensions of the workpieces, and said ring-shaped grinding means having a central axis which extends in the same general direction as said central axis of said work-support means, rotating one of said means about its central axis, and simultaneously displacing the central axis of the other of said means around a third axis parallel to the central axis of said other means while simultaneously rotating the other of said means around the latter central axis to an extent sufficient to create between the gringing surface of said grinding means and the workpieces a cycloidal type of relative movement such that each workpiece and said grinding surface do not cross one with respect to the other during a substantial portion of each revolution of the other of said means and such that a point on each workpiece at the surface thereof which is to be ground and said grinding surface cross one with respect to the other at least twice to an extent situating said point inside and outside said ring-shaped surface during the remaining portion of each revolution of the other of said means.

2. In a method as recited in claim 1 and wherein the workpieces are arranged along at least part of a circle whose center is in the central axis of the work-support means.

3. In a method as recited in claim 1 and wherein the central axis of said work-support means is displaced with respect to said third axis while said grinding means is rotated about the central axis thereof.

4. In a method as recited in claim 1 and wherein said central axes are at a slight angle with respect to each other with the grinding surface of said grinding means being situated in a plane inclined with respect to the surface which is ground by said grinding means on the workpieces.

5. In a method as recited in claim 4 and including the steps of removing ground workpieces from the work-support means and adding workpieces which are to be ground thereto when the workpieces which are removed and added to the work-support means are situated outwardly beyond the grinding means.

6. In a method as recited in claim 1 and wherein the grinding surface of said grinding means is situated in a plane parallel to the surface which is ground on the workpieces, and feeding at least one of said means along its central axis toward the other of said means for determining the extent of grinding of the workpieces.

7. In a method as recited in claim 6 and wherein said third axis and central axis of said one means which is rotated about its own central axis coincide with each other.

8. In a method as recited in claim 7 and wherein the work-support means has its central axis displaced with respect to said third axis while said grinding means is fed along its central axis toward said work-support means.

9. In a method as recited in claim 1 and wherein said grinding surface of said grinding means is situated in a plane inclined with respect to the surface which is ground by said grinding means on the workpieces, removing ground workpieces from said work-support means and adding thereto workpieces which are to be ground when the removed and added workpieces are at a location situated outwardly beyond the grinding means, measuring each ground workpiece before it is removed from said work-support means to determine whether it has been ground within predetermined maximum and minimum limits, and, when a workpiece ground beyond said maximum limit is detected, adjusting said pair of means one with respect to the other to provide for grinding of the workpieces to at least approximately said minimum limit.

10. In a method as recited in claim 1 and including the step of magnetically holding the workpieces on said work-support means.

11. In a surface-grinding apparatus, a pair of means including a work-support means for supporting a plurality of workpieces which are to be ground at locations situated at least in part along a circle and a ring-shaped grinding means having a ring-shaped grinding surface for grinding surfaces of workpieces carried by said work-support means, said pair of means respectively having central axes which extend in the same general direction, rotary drive means operatively connected with one of said pair of means for rotating said one means around its central axis, and cycloidal drive means operatively connected with the other of said pair of means for displacing the central axis of said other means around a third axis parallel to the central axis of said other means while simultaneously rotating the other of said means around said central axis of said other means to an extent sufficient to create between the grinding surface of said grinding means and the workpieces carried by said work-support means a cyloidal type of relative movement such that each workpiece and the ring-shaped grinding surface do not cross one with respect to the other during a substantial portion of each revolution of the other of said means and such that a point on each workpiece and said ring-shaped grinding surface cross one with respect to the other at least twice to an extent situating said point outside and inside of said ring-shaped grinding surface during the remaining portion of each revolution of the other of said means, the latter ring-shaped grinding surface having an inner diameter which is relatively large with respect to the dimensions of the workpieces.

12. The combinaion of claim 11 and wherein said cycloidal drive means is operatively connected with said work-support means while said rotary drive means is operatively connected with said grinding means.

13. The combination of claim 11 and wherein said ring-shaped grinding surface is parallel to the surface which is ground on each workpiece, and feed means operatively connected with at least one of said pair of means for displacing the latter one of said pair of means along its central axis toward the other of said pair of means for grinding the workpieces to a predetermined extent.

14. The combination of claim 13 and wherein said third axis coincides with the central axis of that one of said pair of means which is driven by said rotary drive means.

15. The combination of claim 11 and wherein said grinding surface of said grinding means is situated in a plane which is inclined with respect to the surface which is ground on the workpieces by the grinding means, said central axes being respectively inclined at least slightly one with respect to the other.

16. The combination of claim 11 and wherein the central axis of said work-support means contains the center of the circle along which the workpieces are arranged.

17. The combination of claim 11 and wherein said work-support means includes a plurality of magnetic means for respectively releasably holding the workpieces on said work-support means.

18. The combination of claim 11 and wherein said cycloidal drive means includes a rotary input shaft which is rotated about its own axis, a sun gear fixed to said input shaft for rotation therewith, a plurality of planetary gears surrounding and meshing with said sun gear, said planetary gears respectively having crank pins operatively connected with said other means and spaced equidistantly with respect to the central axis thereof, annular means coaxially surrounding said input shaft while being freely turnable around the latter and supporting said plurality of planetary gears for respective rotation around their own axes while they planetate around said sun gear, a plurality of pinions respectively fixed coaxially to said planetary gears, and a stationary ring gear coaxially surrounding said input shaft and meshing with said pinions so that the latter ride along said ring gear to displace said central axis of said other means around said third axis while said crank pins provide for movement of said central axis of said other means inwardly toward and outwardly away from said third axis, said third axis coinciding with the axis of said input shaft.

19. The combination of claim 18 and wherein said ring gear is an outer ring gear which surrounds the path travelled by said pinions and which has inner teeth meshing with said pinions.

20. The combination of claim 18 and wherein said ring gear is an inner ring gear having outer teeth meshing with said pinions.

21. The combination of claim 11 and wherein said cycloidal drive means is operatively connected with said work-support means, the latter including a circular table carrying at an outer periphery thereof a hollow channel means which has a hollow interior, supply means communicating with the interior of said channel means for supplying a cutting fluid thereto, and discharge means communicating with said channel means for discharging cutting fluid therefrom into engagement with at least those workpieces which are in engagement with the grinding surface of said grinding means.

22. The combination of claim 21 and wherein said channel means and worktable are slidable one with respect to the other, and means operatively connected to said channel means to prevent the latter from rotating with said worktable while permitting said channel means to move with said worktable in opposed directions substantially radially with respect to said third axis.

23. The combination of claim 22 and wherein said channel means is formed with a passage means situated only at an angular portion of said worktable where workpieces carried thereby are engaged by the grinding surface, and said discharge means including outlet nozzles carried by said worktable for rotation therewith and communicating with said passage means to receive cutting fluid therefrom for directing the cutting fluid to the workpieces only when the workpieces are at said angular portion of the worktable where they are in engagement with the grinding wheel.

24. In a method as recited in claim 1 and wherein the grinding surface of said grinding means is situated in a plane parallel to the surface which is ground on the workpieces, feeding at least one of said means along its central axis toward the other of said means for determining the extent of grinding of the workpieces, and locating the workpieces with respect to said grinding surface during grinding of the workpieces substantially at diametrically opposed portions of the grinding surface for eliminating any tendency to tilt said grinding means with resect to its central axis.

25. In a method as recited in claim 24 and wherein said grinding means is said one means which is rotated about its central axis, said workpieces having said cycloidal type of movement with respect to said grinding means and when executing said cycloidal type of movement moving between inner and outer coaxial circular envelopes having a common center situated in the central axis of said grinding means, and situating said grinding surface of said grinding means substantially midway between said envelopes, the average diameter of said grinding surface being substantially equal to half the sum of the diameters of said envelopes.

26. In a method as recited in claim 25 and wherein the circle along which the workpieces are arranged has a diameter substantially equal to the average diameter of said grinding surface.

27. The combination of claim 11 and wherein said rotary drive means is operatively connected with said grinding means for rotating the latter about its central axis, said grinding surface of said grinding means being situated in a plene parallel to the surface which is ground thereby on the workpieces, and said work-support means supporting said workpieces and said cycloidal drive means driving said work-support means in a manner situating workpieces at any instant during the grinding thereof substantially at diametrically opposed portions of said grinding surface.

28. The combination of claim 27 and wherein said cycloidal drive means and work-support means cooperate to provide for the workpieces supported by said work-support means a cycloidal type of movement between a pair of coaxial circular envelopes the common center of which is contained in the central axis of said grinding means, the average diameter of said grinding surface of said grinding means being substantially equal to the average diameters of said envelopes.

29. The combination of claim 28 and wherein said work-support means supports said workpieces along a circle whose diameter is substantially equal to the average diameter of said grinding surface.

30. In a method as recited in claim 1 and wherein said substantial portion of each revolution of the other of said means comprises about one-half of the revolution.

31. The combination of claim 11 and wherein said substantial portion of each revolution of the other of said means comprises about one-half of the revolution.

* * * * *